US005393059A

United States Patent [19]

Winston

[11] Patent Number: 5,393,059

[45] Date of Patent: Feb. 28, 1995

[54] SWITCH FOR ROLLING BALL AMUSEMENT DEVICE

[75] Inventor: Eric P. Winston, Hoffman Estates, Ill.

[73] Assignee: Data East Pinball, Inc., Melrose Park, Ill.

[21] Appl. No.: 191,014

[22] Filed: Feb. 1, 1994

[51] Int. Cl.[6] ..... A63F 7/22

[52] U.S. Cl. ..... 273/118 D; 273/127 R

[58] Field of Search ..... 273/118-125, 273/127 R

[56] References Cited

U.S. PATENT DOCUMENTS 4,180,267 12/1979 Harrop ..... 273/118 A X
4,360,203 11/1982 Garbark ..... 273/121 A
4,438,930 3/1984 Peters ..... 273/127 R

*Primary Examiner*—Mark S. Graham
*Assistant Examiner*—Raleigh W. Chiu
*Attorney, Agent, or Firm*—Gerstman, Ellis & McMillin, Ltd.

[57] ABSTRACT

A rolling ball amusement device such as a pinball game comprises a frame carrying a playfield, and a ball-actuated switch carried with the playfield. The switch comprises a switch body which is movably and typically pivotably connected with a variable-position actuator wire to operate the switch in a manner which is dependent upon the position of the wire. A slot is defined in the playfield, with the actuator wire defining an arc section which is free of angled corners projecting upwardly through the slot. A rolling ball can depress the arc section to actuate the switch with essentially no "hang-up", whether or not the rolling ball approaches the actuator wire from a longitudinal or a lateral direction. Also, a spring urges the actuator wire upwardly out of the depressed position so that the actuator wire only occupies its depressed position when pressed into it by a rolling ball.

4 Claims, 1 Drawing Sheet

Fig. 1
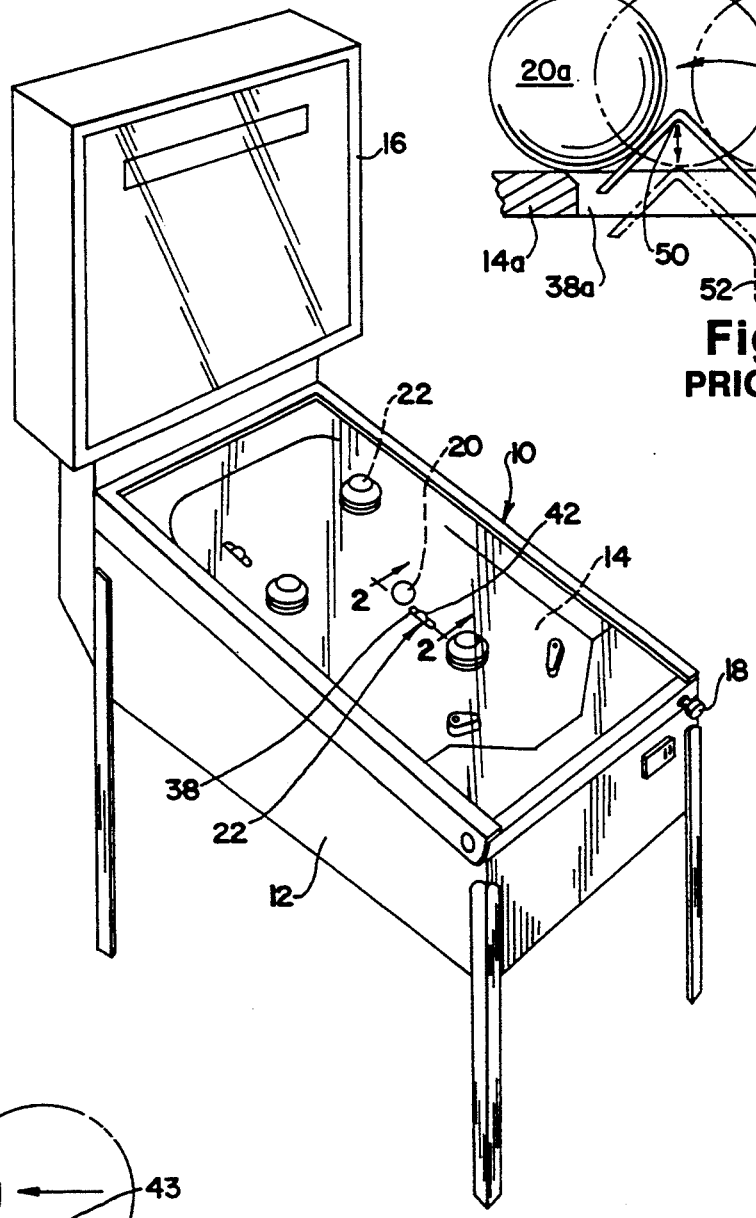
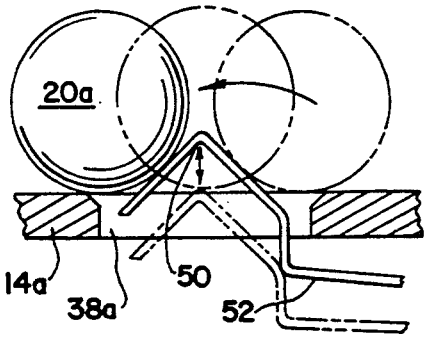
Fig. 3
PRIOR ART
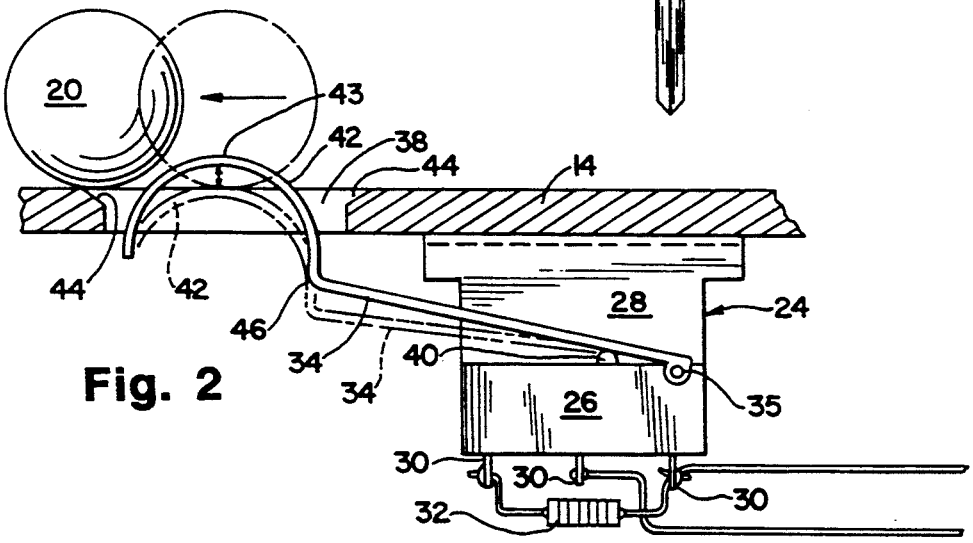
Fig. 2

SWITCH FOR ROLLING BALL AMUSEMENT DEVICE

BACKGROUND OF THE INVENTION

In rolling ball amusement devices such as pinball games, a ball is propelled onto a sloping playfield, so that the ball then rolls typically forward along the playfield, striking various targets as it rolls. It is of course well known to have "flippers" which propel the ball upwardly again on the playfield, away from its lower end, for added scoring if the user has successfully engaged the ball.

One of the ways that scoring is registered in an electronically operated pinball machine is by means of a microswitch carried on the bottom of the playfield, and having an actuator wire projecting upwardly through the playfield, to be engaged and depressed by a rolling ball. When the wire is depressed, a score is recorded.

In the prior art, these microswitch actuator wires have a section thereof which projects through the slot in the playfield to present a ball-engaging portion of the wire which projects above the playfield. This ball engaging wire portion of the prior art comprises a portion of the microswitch actuator wire which is of two straight, integral wire sections connected to each other at an angle. The outer tip of the outermost, straight section typically resides in the slot at all times, with the outermost section being connected by the angle to the next inner section, so that the angle of the wire projects above the playfield more than any other portion of the actuator wire.

However, it has been found that balls rolling on the playfield can become "hung-up" on occasion by this construction. The ball can roll against such a wire with insufficient force to completely depress it, so it "hangs up". Also, a ball rolling laterally with respect to the plane of the angled wire section projecting above the playfield can be captured that way, to hang up and thus delay the game.

By this invention, an improved switching system for rolling ball amusement games is provided, in which a switch actuator wire projects through a slot in the playfield as before, but in which the risk of ball hang up is greatly reduced. This is accomplished with essentially no increase in the cost of the switch system, or any other disadvantages.

DESCRIPTION OF THE INVENTION

By this invention, a rolling ball amusement device is provided which comprises a frame carrying a playfield, and a ball-actuated switch carried with the playfield. The switch of this invention comprises a switch body which is connected with a variable-position actuator, to operate the switch in a manner dependent upon the position of the wire. A slot is defined in the playfield, with the actuator defining an arc section which is free of angled corners, the arc section projecting upwardly through the slot.

As the result of this, a rolling ball can depress the arc section to actuate the switch, with greatly reduced risk of the ball experiencing "hang-up" at the switch. Instead, the balls, in a more uniform and reliable manner, simply depress the arc section and the rest of the actuator to actuate the switch, and then roll away from the switch. Typically, the actuator is a stiff wire, with a curved portion forming the arc section.

Spring means are provided to urge the actuator upwardly out of its depressed position, so that the switch system springs back for another depression by a rolling ball after the first ball has departed.

By this invention, that maximum height of the actuator wire section projecting out of the playfield is typically reduced, rather as if one had cut off the angled peak of the actuator wire of the prior art, and reshaped a lower arc. Surprisingly, the resulting reconfigured actuator of this invention is much less likely to cause the ball to hang up and cease rolling than in the older configuration, no matter from which direction the ball approaches the upwardly projecting actuator wire portion.

Also, the modification of this invention causes the switch and actuator to have a broader tolerance range as to the distance that the arced portion can project upwardly out of the playfield slot, when compared with the prior art. In the prior art, there is very little tolerance in that distance. If the distance is too great, the problem of ball hang up will become quite serious, causing effective breakdown of the game until the ball hang up problem is repaired. If the actuator wire portion projects insufficiently far out of the slot, no switch actuation may take place when the ball rolls over it. By this invention, the new configuration provides a greater tolerance and range of positions, which avoids both of the above disadvantages, and which greatly simplifies the manufacture of rolling ball games making use of the switch of this invention.

DESCRIPTION OF THE DRAWINGS

In the drawings, FIG. 1 is a perspective view of a pinball machine using the switch of this invention;

FIG. 2 is an enlarged, fragmentary, sectional view of a portion of the playfield, showing the switch of this invention and a rolling ball; and FIG. 3 is a sectional view of a corresponding actuator wire portion and playfield slot of the prior art.

DESCRIPTION OF SPECIFIC EMBODIMENTS

Referring to the drawings, a pinball machine 10 is disclosed having a frame 12 which supports a playfield 14 and a backboard 16 in generally conventional manner. A ball launcher 18 is also provided to propel one or more pinballs 20 onto playfield 14. Also, various scoring targets 22 are provided.

In accordance with this invention, one or more targets may be associated with a ball actuated switch system 24. As part of this, a conventional microswitch 26 may be carried on a bracket 28, which may be attached to the underside of playfield 14 or to another structure in conventional manner. For example, a Cherry Manufacturing Co. code D3A Microswitch may be used.

Microswitch 26 may carry a plurality of electrical connectors 30, which may respectively and conventionally be connected to a source of electric power and the scoring system of the pinball machine, so that a score or the like may be indicated when the switch 26 is actuated. Diode 32 also provided in conventional manner.

Microswitch 26 carries a pivotable actuator wire 34, attached at pivot 35, which occupies a range of rotary positions, including an upper position as shown in FIG. 2, and a lower position as shown in phantom lines when ball 20 rolls over the actuator wire 34. Actuator wire 34 projects outwardly through a slot 38 in playfield 14 as shown. This can also include a slot in a ramp, a chute, or other device carried on the playfield, for example.

Spring member 40 urges actuator wire 34 into its upward position, where a curved portion thereof 42 projects outwardly from slot 38, to be depressed by rolling ball 20.

In accordance with this invention, outer, curved portion 42 of actuator wire 34 comprises a smooth, angle-free arc as shown. This outer portion 42 includes that arc portion 43 of actuator wire 34 which projects upwardly through slot 38 and above playfield 14, to be engaged and depressed by rolling ball 20.

As shown in FIG. 3, the prior art switch actuator wire 52 projects through a slot 38*a* of a playfield 14*a*, as shown, to be depressed by a rolling ball 20*a*, to activate its switch. Angle 50 in the wire creates a tendency for the ball to "hang-up", resulting in delay of the game.

The exposed arc shape of section 42 surprisingly results in a very significant reduction of ball "hang-up" in rolling ball games, which greatly increases the reliability of the game and reduces the need for maintenance.

Slot 38 comprises end "ramps" 44, as is conventional.

Actuator wire 34 may have an angle 46 at a position which never projects above playfield 14 in normal operation. It is preferred for the entire portion of the actuator wire projecting out of slot 38 above playfield 14 to comprise a smooth, angle-free arc, as shown in FIG. 2, for the maximum improvement of this invention.

Also, the exact, vertical placement of switch 26 and wire section 42 is less critical because of the modification of this invention, which has a greater range of operative, vertical positions when compared with the corresponding range of the prior art switch. This of course simplifies the manufacturing process necessary for effective emplacement of the switch of this invention.

Thus, a switch for a rolling ball game is provided which is essentially of no increased cost to manufacture, but which exhibits a substantial improvement in the ball handling ability, when compared with the prior art. Games do not have to be stopped because of a ball becoming hung up against an actuator wire. At the same time, the overall cost of the emplaced switch may be less because of the greater and more forgiving tolerance of the vertical position of wire section 42, when compared with the prior art, which makes manufacturing easier.

The above has been offered for illustrative purposes only, and is not intended to limit the scope of the invention of this application, which is as defined in the claims below.

That which is claimed is:

1. A rolling ball amusement device which comprises a frame carrying a playfield, and a ball-actuated switch carried with said playfield, said switch comprising a switch body movably connected with a variable-position actuator to operate said switch in a manner dependent upon the position of said actuator; a slot defined in said playfield; said actuator comprising an arcuate wire section free of angled corners projecting upwardly through said slot, whereby a rolling ball can depress said arcuate wire section to actuate said switch; and spring means urging said actuator upwardly out of depressed position.

2. The device of claim 1 in which the arc section is substantially circular.

3. A rolling ball amusement device which comprises a frame carrying a playfield and a ball-actuated switch carried with said playfield, said switch comprising a switch body movably connected with a stiff actuator wire to operate said switch in a manner dependent upon the position of said wire; a slot defined in said playfield; said actuator wire defining an arc section, free of angled corners, projecting upwardly through said slot, whereby a rolling ball can depress said arc section to actuate said switch; and spring means urging said actuator wire upwardly out of depressed position.

4. The device of claim 3 in which said arc section is circular.

* * * * *